US008226273B2

(12) United States Patent
Lai

(10) Patent No.: US 8,226,273 B2
(45) Date of Patent: Jul. 24, 2012

(54) LED LAMP

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 111 days.

(21) Appl. No.: 12/859,183

(22) Filed: Aug. 18, 2010

(65) Prior Publication Data

US 2012/0001530 A1 Jan. 5, 2012

(30) Foreign Application Priority Data

Jun. 30, 2010 (TW) ..... 99121362 A

(51) Int. Cl.
*F21V 29/00* (2006.01)

(52) U.S. Cl. ..... 362/294; 362/249.02; 362/296.01; 362/373; 362/800

(58) Field of Classification Search ..... 362/249.02, 362/294, 296.01, 373, 800
See application file for complete search history.

(56) References Cited

U.S. PATENT DOCUMENTS

2005/0128752 A1* 6/2005 Ewington et al. ..... 362/294
2009/0046473 A1* 2/2009 Tsai et al. ..... 362/373

* cited by examiner

*Primary Examiner* — Stephen F Husar
*Assistant Examiner* — Meghan Dunwiddie
(74) *Attorney, Agent, or Firm* — Altis Law Group, Inc.

(57) ABSTRACT

A lamp includes a shell and an LED bulb including a heat sink enclosed by the shell. The shell defines at least a hole at a lower portion of the shell and at least an aperture at an upper portion of the shell. The LED bulb includes a heat sink enclosed by the shell. At least an LED is mounted at a bottom of the heat sink. The heat sink includes a plurality of fins extending from top to bottom. The fins define a plurality of channels therebtween. The channels are in flow communication with at least hole and the at least aperture of the shell.

13 Claims, 2 Drawing Sheets

LED LAMP

BACKGROUND

1. Technical Field

The present disclosure relates to an LED lamp, and particularly to an LED lamp having a heat sink and a shell enclosing the heat sink for heat dissipation.

2. Description of Related Art

The technology of light emitting diode (LED) has been rapidly developed in recent years from indicators to illumination applications. With the features of long-term reliability, environment friendliness and low power consumption, the LED is viewed as a promising alternative for future lighting products. Nevertheless, the rate of heat generation increases with the illumination intensity. This issue has become a challenge for engineers to design the LED illumination, i.e. the LED lamp.

A related LED lamp includes a heat sink and a plurality of LED modules including LEDs, attached to an outer surface of the heat sink to enable dissipation of heat generated by the LEDs. In order to provide a high brightness, a reflector is mounted on the LED lamp to cover the heat sink, whereby light generated by the LEDs is repeatedly reflected by the reflector downwardly. However, ambient air around the heat sink is heated to flow upwardly, and then accumulates at a top of the reflector, making dissipation of the heat become problematic.

What is needed, is an LED lamp which has greater heat-transfer and heat dissipation capabilities, whereby the LED lamp can operate normally for a sufficiently long period of time.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
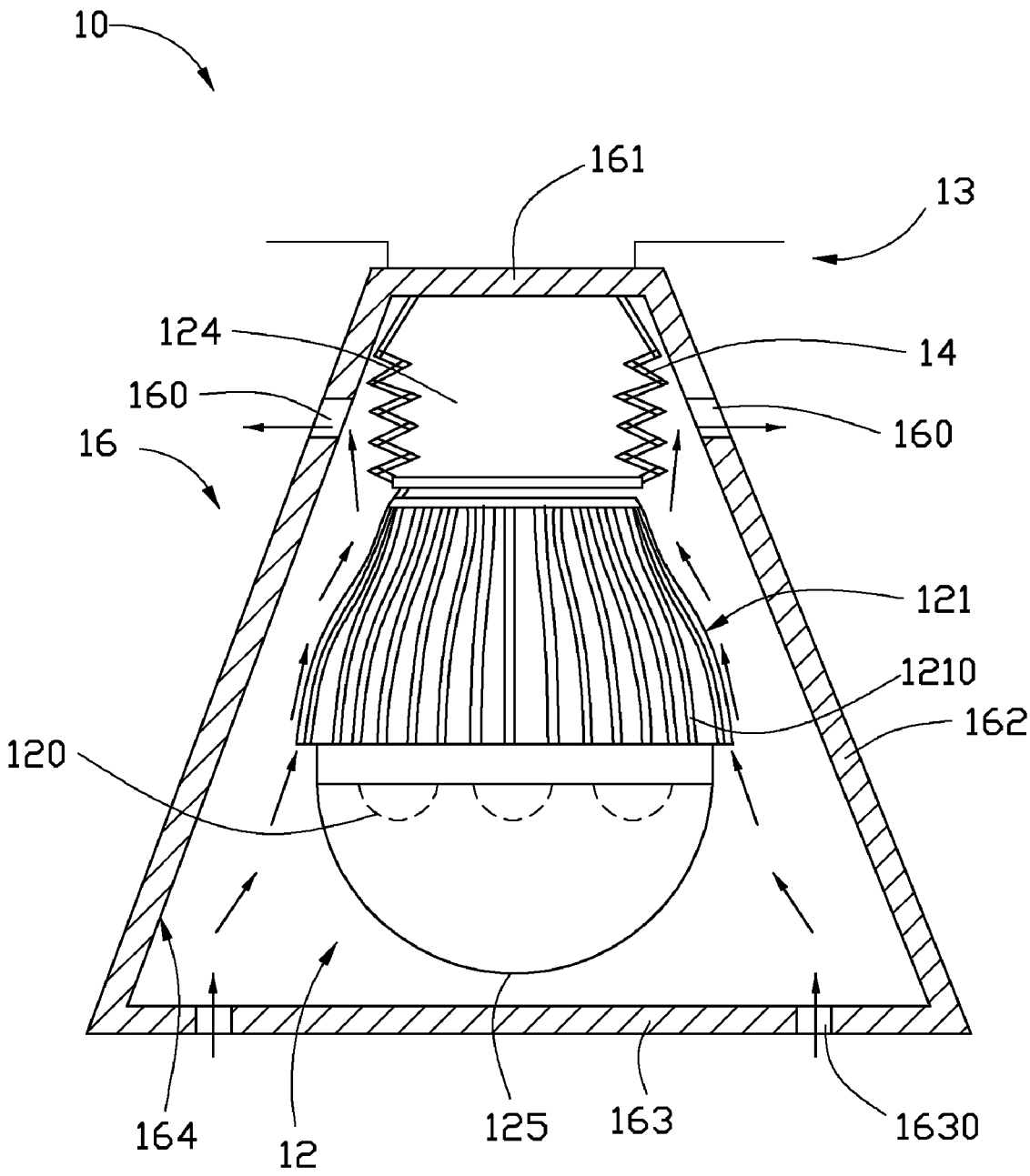
FIG. 1 is a side view of an LED lamp in accordance with a first embodiment of the present disclosure, wherein a cross-sectional of a shell of the LED lamp is shown.

Referring to FIG. 1, an LED (light emitting diode) lamp 10 in accordance with a first embodiment of the disclosure is illustrated. The LED lamp 10 comprises an LED bulb 12 and a shell 16 enclosing the LED bulb 12. The LED bulb 12 includes a heat sink 121, an LED module 120 mounted at a bottom of the heat sink 121, and a connector 124 engaging at a top of the heat sink 121. A lamp holder 14 is installed in the shell 16 for electrically engaging the connector 124 of the LED bulb 12. In this embodiment, the shell 16 has a height larger than that of the whole LED bulb 12.

The heat sink 121 comprises a heat conducting body (not labeled), and a plurality of radial partition fins 1210 extending from an outer surface of the body. The radial partition fins 1210 extend along a direction from top to bottom. Two neighboring fins 1210 are spaced apart from one another with a channel therebetween. The LED module 120 comprises a plurality of LEDs (not labeled) installed at the bottom of the heat conducting body. A hemispherical, transparent cover 125 is engaged with the bottom of the heat sink 121 and covers the LED module 120. The transparent cover 125 is so dimensioned and positioned that bottom intakes of the channels between the fins 1210 are exposed downward to the surrounding air, without being blocked by the cover 125. Thus, air can easily flow upwardly along the cover 125 into the channels between the fins via the bottom intakes thereof.

The shell 16 is inverted frustum-shaped and comprises a top plate 161, a bottom plate 163 and a lateral wall 162 interconnecting with the top plate 161 and the bottom plate 163. The lamp holder 14 is mounted at the top plate 161 for connecting the connector 124 of the LED bulb 12. The lateral wall 162 is around the LED bulb 12 and has an angled inner surface 164 defined at an acute angle with respect to the bottom plate 163. The lateral wall 162 can be made of metal material which can reflect light. The bottom plate 163 is transparent. A part of light generated by the LED module 120 radiates downwardly directly through the transparent bottom plate 163. Another part of the light generated by the LED module 120 is reflected by the inner surface 164 of the lateral wall 162 to radiate downwardly through the transparent bottom plate 163. The lateral wall 162 defines a plurality of apertures 160 at a top portion thereof near a top of the heat sink 121; in other words, the apertures 160 is near outlets of the channels of the heat sink 121. The bottom plate 163 defines a plurality of holes 1630 near an edge thereof. The holes 1630 corresponds to the channels defined between the fins 1210.

According to the present disclosure, heat produced by the LED module 120 can be quickly transferred to the heat sink 121 via a thermal connection between the LED module 120 and the heat conducting body. The heat is transferred to the fins 1210, and is then dissipated away to ambient air via the fins 1210. Air in the channels defined between the fins 1210 is heated. The channels each function as a chimney for guiding the heated air to flow upwardly and outwardly to the apertures 160 of the lateral wall 162. The heated air is replaced by outside cooler air flowing from the holes 1630 of the bottom plate 163 into the shell 16 and toward the channels. By the provision of the channels in flow communication with the lower holes 1630 and the upper apertures 160, a natural air convection through the channels between the fins 1210 can be established, whereby the heat dissipation efficiency of the heat sink 121 can be improved. Thus, the heat produced by the LEDs can be removed by the heat sink 121 very quickly, thereby enabling the LED module 120 to work within a required temperature range.

Alternatively, the holes 1630 can be defined at a bottom portion of the lateral wall 162. The connector 124 can be designed to insert in the holder 14 to electrically connect the holder 14. The connector 124 of the LED bulb 12 can be standard component and available in the market, such as E26, E27, GU10, PAR30 or MR16. Furthermore, when the LED lamp 10 is used in an inverted position, the heated air in the channels among the fins 1210 flows upwardly and outwardly to the holes 1630 of the lateral walls 160, and replaced by outside cooler air flowing through the apertures 1630 of the bottom plate 163 into the shell 16.

Figure 2:
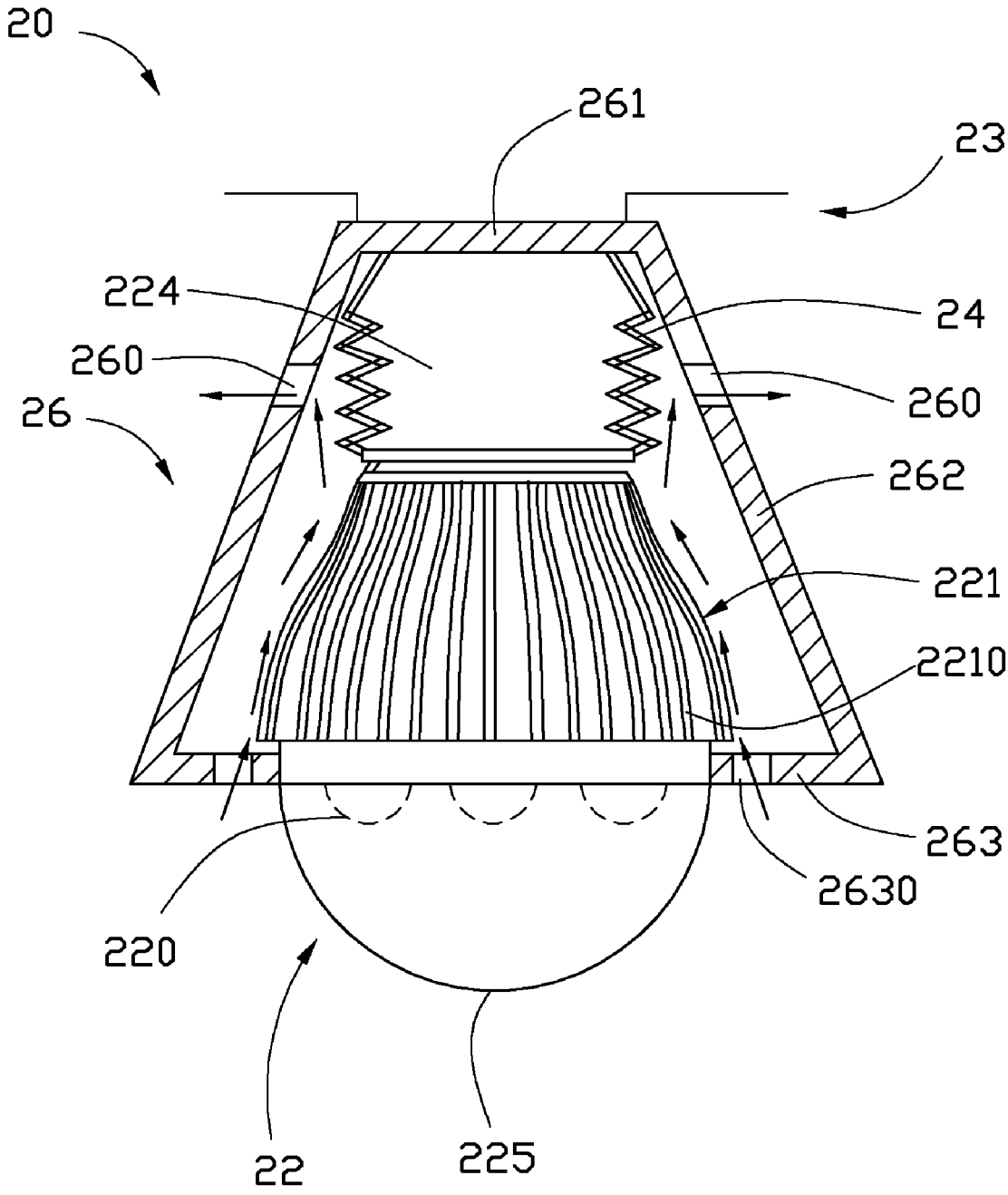
FIG. 2 is a view similar to FIG. 1, but showing an LED lamp in accordance with a second embodiment of the present disclosure.

Referring to FIG. 2, an LED lamp 20 in accordance with a second embodiment of the disclosure is illustrated. The LED lamp 20 comprises an LED bulb 22 and a shell 26 enclosing the LED bulb 22. The LED bulb 22 includes a heat sink 221, an LED module 220 with a plurality of LEDs (not labeled) mounted at a bottom of the heat sink 221, a transparent cover 225 covering the LED module 220, and a connector 224 engaging at a top of the heat sink 221. The heat sink 221 has a plurality of radial partition fins 2210. The shell 26 is inverted frustum-shaped and comprises a top plate 261, a bottom plate 263 and a lateral wall 262 interconnecting with the top plate 261 and the bottom plate 263. The lateral wall 262 defines a plurality of apertures 260 at a top portion thereof, and the bottom plate 263 defines a plurality of holes 2630 near an edge of thereof.

Different from the LED lamp 10 of the first embodiment, the LED module 220 and the cover 225 of the LED lamp 20 extend through the bottom plate 263 of the shell 26. The heat sink 221 is received in the shell 26. The bottom plate 263 of the shell 26 is installed between the heat sink 221 and the LED module 220. In other words, the shell 26 has a height less than that of the whole LED bulb 22. Heat produced by the LED module 220 can be quickly transferred to the fins 2210. The air in the channels defined between the fins 2210 is heated to flow out of the apertures 260 and replaced by cooler air flowing into the shell 26 from the holes 2630. Since the shell 26 has a height less than that of the whole LED bulb 22, air flowing through the shell 26 from bottom to top thereof is more quick than air flowing through the shell 16 of the first embodiment.

It is to be understood, however, that even though numerous characteristics and advantages of various embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) lamp, comprising:

a shell defining at least a hole at a lower portion of the shell and at least an aperture at an upper portion of the shell; and an LED bulb comprising a heat sink enclosed by the shell, and at least an LED mounted at a bottom of the heat sink, the heat sink having a plurality of fins extending from top to bottom, the fins defining a plurality of channels therebtween, the channels being in flow communication with the at least hole and the at least aperture of the shell;

wherein the shell comprises a top plate, a transparent bottom plate, and a lateral wall interconnecting with the top plate and the bottom plate, the lateral wall reflecting light generated by the at least LED to the bottom plate.

2. The lamp of the claim 1, wherein the lateral wall is defined at an acute angle with respect to the bottom plate.

3. The lamp of the claim 1, wherein the at least hole is defined at the bottom plate, and the at least aperture is defined at an upper portion of the lateral wall, the at least hole corresponding to bottom ends of the channels of the fins.

4. The lamp of the claim 1, wherein the at least hole is defined at an bottom portion of the lateral wall, and the at least aperture is defined at an upper portion of the lateral wall.

5. The lamp of the claim 1, wherein the bottom plate of the shell is between the heat sink and the at least LED.

6. The lamp of the claim 1, wherein the LED bulb further comprises a connector connecting the heat sink and electrically connecting the at least LED, the shell comprising a lamp holder installed at the top plate of the shell and electrically connecting the connector.

7. The lamp of the claim 1, wherein the shell has a height larger than a height of the LED bulb, and the whole LED bulb is received in the shell.

8. The lamp of the claim 1, wherein the shell has a height less than a height of the LED bulb, and the LED bulb has a cover enclosing the at least LED and extending through the bottom plate of the shell.

9. An LED (light emitting diode) lamp, comprising:

a shell defining a plurality holes at a lower portion of the shell and a plurality of apertures at an upper portion of the shell; and an LED bulb comprising a heat sink enclosed by the shell, a plurality of LEDs mounted at a bottom of the heat sink, the heat sink having a plurality of fins extending from top to bottom, the fins defining a plurality of channels therebtween;

wherein heat produced by the LEDs is transferred to fins of the heat sink and dissipated to air in the channels, the heated air flowing upwardly and outwardly to the apertures of the shell, and replaced by outside cooler air flowing into the shell through the holes; and wherein the shell comprises a transparent plate and a lateral wall connecting the transparent plate, the lateral wall reflecting light generated by the LEDs outwardly and through the transparent plate.

10. The lamp of the claim 9, wherein the shell has a height larger than a height of the LED bulb, and the whole LED bulb is received in the shell.

11. The lamp of the claim 9, wherein the shell has a height less than a height of the LED bulb, and the LED bulb has a cover enclosing the LEDs and extending through the bottom plate of the shell.

12. The lamp of the claim 9, wherein the transparent plate of the shell is between the heat sink and the LEDs.

13. The lamp of the claim 9, wherein the apertures of the shell corresponds to the channels of the fins of the heat sink.

* * * * *